US008328891B2

(12) United States Patent
Zhang et al.

(10) Patent No.: US 8,328,891 B2
(45) Date of Patent: Dec. 11, 2012

(54) METHODS OF FORMING THERMALLY STABLE POLYCRYSTALLINE DIAMOND CUTTERS

(75) Inventors: Youhe Zhang, Spring, TX (US); Yuelin Shen, Houston, TX (US)

(73) Assignee: Smith International, Inc., Houston, TX (US)

( * ) Notice: Subject to any disclaimer, the term of this patent is extended or adjusted under 35 U.S.C. 154(b) by 145 days.

(21) Appl. No.: 12/505,316

(22) Filed: Jul. 17, 2009

(65) Prior Publication Data

US 2009/0313908 A1 Dec. 24, 2009

Related U.S. Application Data

(63) Continuation-in-part of application No. 11/745,726, filed on May 8, 2007, now Pat. No. 8,066,087.

(60) Provisional application No. 60/799,104, filed on May 9, 2006, provisional application No. 61/081,626, filed on Jul. 17, 2008.

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24D 3/02*** | (2006.01) |
| ***C09K 3/14*** | (2006.01) |
| ***C09C 1/68*** | (2006.01) |

(52) U.S. Cl. ..... 51/293; 51/300; 51/307; 51/309

(58) Field of Classification Search ..... 51/293, 51/300, 307, 309

See application file for complete search history.

(56) References Cited

U.S. PATENT DOCUMENTS

| | | | | |
|---|---|---|---|---|
| 2,941,241 | A | | 6/1960 | Strong |
| 2,941,248 | A | | 6/1960 | Hall |
| 2,947,611 | A | | 8/1960 | Bundy |
| 3,609,818 | A | | 10/1971 | Wentorf, Jr. |
| 3,767,371 | A | | 10/1973 | Wentorf, Jr. et al. |
| 4,104,344 | A | | 8/1978 | Pope et al. |
| 4,224,380 | A | | 9/1980 | Bovenkerk et al. |
| 4,288,248 | A | | 9/1981 | Bovenkerk et al. |
| 4,289,503 | A | | 9/1981 | Corrigan |
| 4,525,178 | A | | 6/1985 | Hall |
| 4,572,722 | A | * | 2/1986 | Dyer ..... 51/309 |
| 4,629,373 | A | * | 12/1986 | Hall ..... 407/118 |
| 4,673,414 | A | | 6/1987 | Lavens et al. |
| 4,694,918 | A | | 9/1987 | Hall |

(Continued)

FOREIGN PATENT DOCUMENTS

EP 1190791 A2 3/2002

(Continued)

OTHER PUBLICATIONS

Third-Party Submission Under 37 C.F.R. 1.99 for U.S. Appl. No. 12/505,316, dated Jan. 21, 2010 (3 pages).

(Continued)

*Primary Examiner* — James McDonough
(74) *Attorney, Agent, or Firm* — Osha Liang LLP

(57) ABSTRACT

A method for forming a thermally stable cutting element that includes forming at least one acid infusion pathway in a polycrystalline abrasive body containing a catalyzing material to be leached; and contacting at least a portion of the at least one acid infusion pathway in the polycrystalline abrasive body with a leaching agent is disclosed.

16 Claims, 3 Drawing Sheets

U.S. PATENT DOCUMENTS

| | | | | |
|---|---|---|---|---|
| 4,784,023 | A | 11/1988 | Dennis | |
| 4,944,772 | A | 7/1990 | Cho | |
| 4,954,139 | A | 9/1990 | Cerutti | |
| 4,984,642 | A * | 1/1991 | Renard et al. | 175/430 |
| 4,987,800 | A | 1/1991 | Gasan et al. | |
| 5,011,515 | A | 4/1991 | Frushour | |
| 5,127,923 | A | 7/1992 | Bunting et al. | |
| 5,355,969 | A * | 10/1994 | Hardy et al. | 175/432 |
| 5,370,195 | A | 12/1994 | Keshavan et al. | |
| 5,494,477 | A | 2/1996 | Flood et al. | |
| 5,564,511 | A | 10/1996 | Frushour | |
| 5,605,198 | A | 2/1997 | Tibbitts et al. | |
| 5,722,497 | A | 3/1998 | Gum et al. | |
| 5,875,862 | A | 3/1999 | Jurewicz et al. | |
| 6,009,963 | A | 1/2000 | Chaves et al. | |
| 6,041,875 | A * | 3/2000 | Rai et al. | 175/432 |
| 6,131,678 | A | 10/2000 | Griffin | |
| 6,193,001 | B1 | 2/2001 | Eyre et al. | |
| 6,196,341 | B1 | 3/2001 | Chaves | |
| 6,298,930 | B1 | 10/2001 | Sinor et al. | |
| 6,315,065 | B1 | 11/2001 | Yong et al. | |
| 6,410,085 | B1 | 6/2002 | Griffin et al. | |
| 6,447,560 | B2 | 9/2002 | Jensen et al. | |
| 6,550,556 | B2 | 4/2003 | Middlemiss et al. | |
| 6,605,798 | B1 | 8/2003 | Cullen | |
| 6,892,836 | B1 | 5/2005 | Eyre et al. | |
| 7,108,598 | B1 | 9/2006 | Galloway | |
| 7,316,279 | B2 | 1/2008 | Wiseman et al. | |
| 7,377,341 | B2 | 5/2008 | Middlemiss et al. | |
| 8,028,771 | B2 | 10/2011 | Keshavan et al. | |
| 2002/0034631 | A1 | 3/2002 | Griffin et al. | |
| 2002/0034632 | A1 | 3/2002 | Griffin et al. | |
| 2002/0071729 | A1 | 6/2002 | Middlemiss et al. | |
| 2005/0263328 | A1 | 12/2005 | Middlemiss | |
| 2006/0157285 | A1 | 7/2006 | Cannon et al. | |
| 2006/0191723 | A1 | 8/2006 | Keshavan | |
| 2006/0207802 | A1 | 9/2006 | Zhang et al. | |
| 2006/0266558 | A1 | 11/2006 | Middlemiss et al. | |
| 2006/0266559 | A1 | 11/2006 | Keshavan et al. | |
| 2007/0181348 | A1 | 8/2007 | Lancaster et al. | |
| 2008/0085407 | A1 | 4/2008 | Cooley et al. | |
| 2008/0142276 | A1 | 6/2008 | Griffo et al. | |
| 2008/0185189 | A1 | 8/2008 | Griffo et al. | |
| 2008/0223621 | A1 | 9/2008 | Middlemiss et al. | |
| 2008/0223623 | A1 | 9/2008 | Keshavan et al. | |
| 2009/0090563 | A1 | 4/2009 | Voronin et al. | |
| 2009/0152017 | A1 | 6/2009 | Shen et al. | |
| 2010/0015140 | A1 | 1/2010 | Danter | |
| 2010/0181117 | A1 | 7/2010 | Scott | |
| 2011/0023375 | A1 | 2/2011 | Sani et al. | |

FOREIGN PATENT DOCUMENTS

| | | | |
|---|---|---|---|
| GB | 2351747 | A | 1/2001 |
| GB | 2367081 | A | 3/2002 |
| GB | 2413575 | A | 11/2005 |
| GB | 2422623 | A | 8/2006 |
| GB | 2429471 | A | 2/2007 |
| GB | 2429727 | A | 3/2007 |
| WO | 2009051022 | A2 | 4/2009 |
| WO | 2010098978 | A1 | 9/2010 |

OTHER PUBLICATIONS

International Search Report with Written Opinion issued in related International Application No. PCT/US2009/051022 dated Feb. 24, 2010. (11 pages).

International Search Report with Written Opinion issued in related International Application No. PCT/US2009/051047 dated Feb. 24, 2010. (12 pages).

Third-Party Submission Under 37 C.F.R. 1.99 for U.S. Appl. No. 12/505,316, dated Feb. 8, 2010 (3 pages).

Examination Report issued in Unitd Kingdom Application No. GB0708915.4 dated Jun. 30, 2010 (1 page).

Examination Report issued in related British Patent Application No. GB0708915.4; Dated Dec. 6, 2010 (5 pages).

Examination Report issued in related UK Patent Application No. GB1101214.3; Dated Jan. 27, 2012 (2 pages).

* cited by examiner

METHODS OF FORMING THERMALLY STABLE POLYCRYSTALLINE DIAMOND CUTTERS

CROSS-REFERENCE TO RELATED APPLICATIONS

This application is a continuation-in-part of, and claiming priority under 35 U.S.C. §120 to, U.S. patent application Ser. No. 11/745,726, filed on May 8, 2007, which claims priority under 35 U.S.C. §119 to U.S. patent application Ser. No. 60/799,104, filed on May 9, 2006. This application also claims priority under 35 U.S.C. §119 to U.S. patent application Ser. No. 61/081,626, filed on Jul. 17, 2008. All of these applications are incorporated by reference in their entirety.

BACKGROUND OF INVENTION

1. Field of the Invention

The invention relates generally to polycrystalline diamond composites and cutting structures. More particularly, this invention relates to polycrystalline diamond cutting structures that have a high thermal stability.

2. Background Art

Polycrystalline diamond compact ("PDC") cutters have been used in industrial applications including rock drilling and metal machining for many years. In a typical application, a compact of polycrystalline diamond (PCD) (or other superhard material) is bonded to a substrate material, which is typically a sintered metal-carbide to form a cutting structure. PCD comprises a polycrystalline mass of diamonds (typically synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter may be formed by placing a cemented carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often comprises a metal-carbide composite material, such as tungsten carbide. The deposited diamond layer is often referred to as the "diamond table" or "abrasive layer."

Conventional PCD includes 85-95% by volume diamond and a balance of the binder material, which is present in PCD within the interstices existing between the bonded diamond grains. Binder materials that are typically used in forming PCD include Group VIII elements, with cobalt (Co) being the most common binder material used.

An example of a drag bit for earth formation drilling using PDC cutters is shown in FIG. 1. FIG. 1 shows a rotary drill bit 10 having a bit body 12. The lower face of the bit body 12 is formed with a plurality of blades 14, which extend generally outwardly away from a central longitudinal axis of rotation 16 of the drill bit. A plurality of PDC cutters 18 are disposed side by side along the length of each blade. The number of PDC cutters 18 carried by each blade may vary. The PDC cutters 18 are individually brazed to a stud-like carrier (or substrate), which may be formed from tungsten carbide, and are received and secured within sockets in the respective blade.

A significant factor in determining the longevity of PDC cutters is the generation of heat at the cutter contact point, specifically at the exposed part of the PDC layer, caused by friction between the PCD and the work material. This heat causes thermal damage to the PCD in the form of cracks (due to differences in thermal expansion coefficients) which lead to spalling of the polycrystalline diamond layer, delamination between the polycrystalline diamond and substrate, and back conversion of the diamond to graphite causing rapid abrasive wear. The thermal operating range of conventional PDC cutters is typically 700° C. or less.

As mentioned, conventional polycrystalline diamond is stable at temperatures of up to 700° C., after which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. However, thermal fatigue does not only occur at temperatures above 700° C. Rather, the differential expansion (between cobalt and diamond) even occurs at temperatures as low as 300-400° C., still causing thermal fatigue in the diamond body. Further, damage to polycrystalline diamond can also result from the loss of some diamond-to-diamond bonds (from the initiation of a graphitization process) leading to loss of microstructural integrity and strength loss.

In order to overcome this problem, strong acids may be used to "leach" the cobalt from the diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically nitric acid or combinations of several strong acids (such as nitric and hydrofluoric acid) may be used to treat the diamond table, removing at least a portion of the co-catalyst from the PDC composite. By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such as by processes known in the art and described in U.S. Pat. No. 5,127,923, which is herein incorporated by reference in its entirety.

While leaching processes with nitric/hydrofluoric acid are successful, they tend to be lengthy and dangerous. Further, leaching with stronger concentrations of acid would create an extremely hazardous working environment. Using mixtures of acids can easily take many weeks in order to leach out the cobalt. Additionally for higher diamond density materials (used when greater abrasion resistance is desired), leaching of the high density material may be extremely difficult because it is more difficult for a leaching agent to diffuse through a diamond body having such a low porosity that accompanies the high density.

Accordingly, there exists a continuing need for methods that accelerate the leaching process.

SUMMARY OF INVENTION

In one aspect, embodiments disclosed herein relate to a method for forming a thermally stable cutting element that includes forming at least one acid infusion pathway in a polycrystalline abrasive body containing a catalyzing material to be leached; and contacting at least a portion of the at least one acid infusion pathway in the polycrystalline abrasive body with a leaching agent.

In another aspect, embodiments disclosed herein relate to a method for forming a thermally stable cutting element that includes forming a polycrystalline diamond compact of a polycrystalline diamond body attached to a substrate where the formation of the polycrystalline diamond compact includes placing a mixture of diamond particles and a catalyst material adjacent a substrate; and subjecting the mixture and substrate to high-pressure/high temperature conditions; then, once the polycrystalline diamond compact is formed, detaching the polycrystalline diamond body from the substrate; forming at least one cavity in the detached polycrystalline diamond body; and contacting the detached polycrystalline diamond body with a leaching agent.

In yet another aspect, embodiments disclosed herein relate to a thermally stable cutting element that includes a polycrystalline abrasive body having at least one cavity formed in an interior portion of a working surface of the polycrystalline abrasive body.

Other aspects and advantages of the invention will be apparent from the following description and the appended claims.

DETAILED DESCRIPTION

Figure 1:
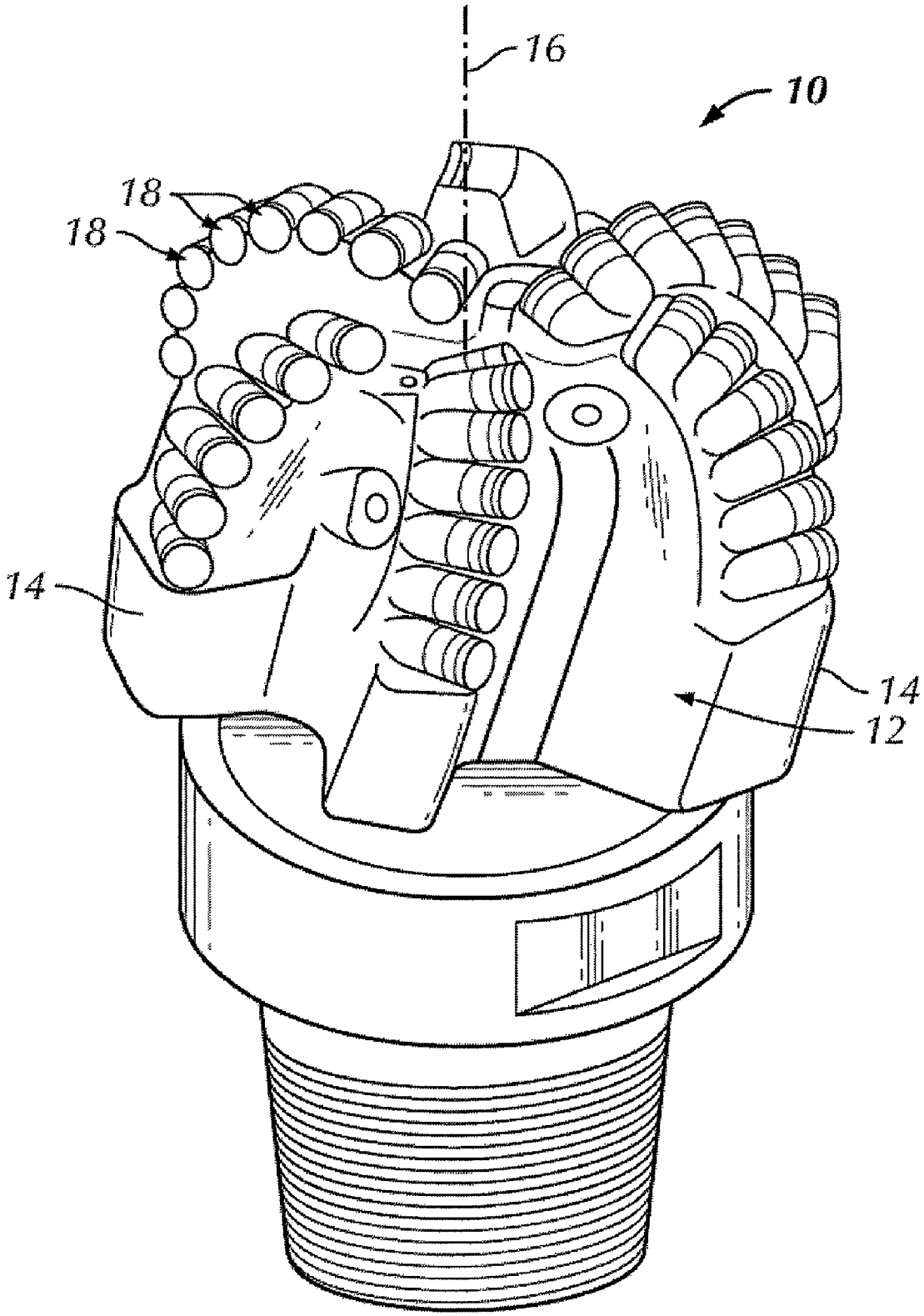
FIG. 1 is an illustration of a PDC drill bit.

In one aspect, embodiments disclosed herein relate to thermally stable cutting elements and methods for decreasing the amount of time required to leach a polycrystalline diamond body or cutter to a desired depth. More specifically, embodiments disclosed herein involve accelerating techniques used in conjunction with treatments of a leaching agent to remove undesired material (such as a catalyst) used in the manufacture of a diamond table. In particular, the accelerating techniques that may be used in conjunction with conventional leaching include formation of acid infusion pathways in a polycrystalline abrasive body such as polycrystalline diamond (PCD) to increase the access of the leaching agent to the interior regions of the polycrystalline body.

As used herein, the term "PCD" refers to polycrystalline diamond that has been formed, at high pressure/high temperature (HPHT) conditions, through the use of a solvent metal catalyst, such as those included in Group VIII of the Periodic table. The term "thermally stable polycrystalline diamond," as used herein, refers to intercrystalline bonded diamond that includes a volume or region that has been rendered substantially free of the solvent metal catalyst used to form PCD, or the solvent metal catalyst used to form PCD remains in the region of the diamond body but is otherwise reacted or rendered ineffective in its ability to adversely impact the bonded diamond at elevated temperatures as discussed above.

Forming Polycrystalline Diamond

A polycrystalline diamond body may be formed in a conventional manner, such as by a high pressure, high temperature sintering of "green" particles to create intercrystalline bonding between the particles. "Sintering" may involve a high pressure, high temperature (HPHT) process. Examples of high pressure, high temperature (HPHT) process can be found, for example, in U.S. Pat. Nos. 4,694,918; 5,370,195; and 4,525,178. Briefly, to form the polycrystalline diamond object, an unsintered mass of diamond crystalline particles is placed within a metal enclosure of the reaction cell of a HPHT apparatus. A suitable HPHT apparatus for this process is described in U.S. Pat. Nos. 2,947,611; 2,941,241; 2,941,248; 3,609,818; 3,767,371; 4,289,503; 4,673,414; and 4,954,139. A metal catalyst, such as cobalt or other Group VIII metals, may be included with the unsintered mass of crystalline particles to promote intercrystalline diamond-to-diamond bonding. The catalyst material may be provided in the form of powder and mixed with the diamond grains, or may be infiltrated into the diamond grains during HPHT sintering An exemplary minimum temperature is about 1200° C. and an exemplary minimum pressure is about 35 kilobars. Typical processing is at a pressure of about 45 kbar and 1300° C. Those of ordinary skill will appreciate that a variety of temperatures and pressures may be used, and the scope of the present invention is not limited to specifically referenced temperatures and pressures.

Diamond grains useful for forming a polycrystalline diamond body may include any type of diamond particle, including natural or synthetic diamond powders having a wide range of grain sizes. For example, such diamond powders may have an average grain size in the range from submicrometer in size to 100 micrometers, and from 1 to 80 micrometers in other embodiments. Further, one skilled in the art would appreciate that the diamond powder may include grains having a mono- or multi-modal distribution.

Moreover, the diamond powder used to prepare the PCD body may be synthetic diamond powder or natural diamond powder. Synthetic diamond powder is known to include small amounts of solvent metal catalyst material and other materials entrained within the diamond crystals themselves. Unlike synthetic diamond powder, natural diamond powder does not include such solvent metal catalyst material and other materials entrained within the diamond crystals. It is theorized that that inclusion of materials other than the solvent catalyst in the synthetic diamond powder can operate to impair or limit the extent to which the resulting PCD body can be rendered thermally stable, as these materials along with the solvent catalyst must also be removed or otherwise neutralized. Because natural diamond is largely devoid of these other materials, such materials do not have to be removed from the PCD body and a higher degree of thermal stability may thus be obtained. Accordingly, for applications calling for a particularly high degree of thermal stability, one skilled in the art would appreciate that the use of natural diamond for forming the PCD body may be preferred. The diamond grain powder, whether synthetic or natural, may be combined with or already includes a desired amount of catalyst material to facilitate desired intercrystalline diamond bonding during HPHT processing. Suitable catalyst materials useful for forming the PCD body include those solvent metals selected from the Group VIII of the Periodic table, with cobalt (Co) being the most common, and mixtures or alloys of two or more of these materials. In a particular embodiment, the diamond grain powder and catalyst material mixture may comprise 85 to 95% by volume diamond grain powder and the remaining amount catalyst material. Alternatively, the diamond grain powder can be used without adding a solvent metal catalyst in applications where the solvent metal catalyst can be provided by infiltration during HPHT processing from the adjacent substrate or adjacent other body to be bonded to the PCD body.

The diamond powder may be combined with the desired catalyst material, and the reaction cell is then placed under processing conditions sufficient to cause the intercrystalline bonding between the diamond particles. In the event that the formation of a PCD compact comprising a substrate bonded to the PCD body is desired, a selected substrate is loaded into the container adjacent the diamond powder mixture prior to HPHT processing. Additionally, in the event that the PCD body is to be bonded to a substrate, and the substrate includes a metal solvent catalyst, the metal solvent catalyst needed for catalyzing intercrystalline bonding of the diamond may be provided by infiltration, in which case it may not be necessary to mix the diamond powder with a metal solvent catalyst prior to HPHT processing.

In an example embodiment, the device is controlled so that the container is subjected to a HPHT process comprising a pressure in the range of from 4 to 7 GPa and a temperature in the range of from about 1320 to 1600° C., for a sufficient period of time. During this HPHT process, the catalyst material in the mixture melts and infiltrates the diamond grain powder to facilitate intercrystalline diamond bonding. During the formation of such intercrystalline diamond bonding, the catalyst material may migrate into the interstitial regions within the microstructure of the so-formed PCD body that exists between the diamond bonded grains It should be noted that if too much additional non-diamond material is present in the powdered mass of crystalline particles, appreciable intercrystalline bonding is prevented during the sintering process. Such a sintered material where appreciable intercrystalline bonding has not occurred is not within the definition of PCD. Following such formation of intercrystalline bonding, a polycrystalline diamond body may be formed that has, in one embodiment, at least about 80 percent by volume diamond, with the remaining balance of the interstitial regions between the diamond grains occupied by the catalyst material. In other embodiments, such diamond content may comprise at least 85 percent by volume of the formed diamond body, and at least 90 percent by volume in yet another embodiment. However, one skilled in the art would appreciate that other diamond densities (or gradients of diamond densities) may be used in alternative embodiments. In particular embodiments, the polycrystalline diamond bodies being leached in accordance with the present disclosure include what is frequently referred to in the art as "high density" polycrystalline diamond, which refers to a diamond body having a diamond content of at least 90 percent by volume. However, in other embodiments, the high density polycrystalline diamond used in the method of the present disclosure may have a density of at least 92 percent by volume up to 97 percent by volume. One skilled in the art would appreciate that conventionally, as diamond density increases, the leaching time (and potential inability to effectively leach) similarly increases.

Further, one skilled in the art would appreciate that, frequently, a diamond layer is sintered to a carbide substrate by placing the diamond particles on a preformed substrate in the reaction cell and sintering. However the present disclosure is not so limited. Rather, the polycrystalline diamond bodies treated in accordance with the present disclosure may or may not be attached to a substrate.

In a particular embodiment, the polycrystalline diamond body is formed using solvent catalyst material provided as an infiltrant from a substrate, for example, a WC-Co substrate, during the HPHT process. In such embodiments where the polycrystalline diamond body is formed with a substrate, it may be desirable to remove the polycrystalline diamond portion from the substrate prior to leaching so that leaching agents may attack the diamond body in an unshielded manner, i.e., from all sides of the diamond body without substantial restriction.

Further, one skilled in the art would appreciate that the same techniques used with polycrystalline diamond may be applied to polycrystalline cubic boron nitride (PCBN). Similar to polycrystalline diamond, PCBN may be formed by sintering boron nitride particles (typically CBN) via a HPHT process, similar to those for PCD, to sinter "green" particles to create intercrystalline bonding between the particles. CBN refers to an internal crystal structure of boron atoms and nitrogen atoms in which the equivalent lattice points are at the corner of each cell. Boron nitride particles typically have a diameter of approximately one micron and appear as a white powder. Boron nitride, when initially formed, has a generally graphite-like, hexagonal plate structure. When compressed at high pressures (such as 106 psi), CBN particles will be formed with a hardness very similar to diamond, and a stability in air at temperatures of up to 1400° C.

According to one embodiment of the invention, PCBN may include a content of boron nitride of at least 50% by volume; at least 70% by volume in another embodiment; at least 85% by volume in yet another embodiment. In another embodiment, the cubic boron nitride content may range from 50 to 80 percent by volume, and from 80 to 99.9 percent by volume in yet another embodiment. The residual content of the polycrystalline cubic boron nitride composite may include at least one of Al, Si, and mixtures thereof, carbides, nitrides, carbonitrides and borides of Group IVa, Va, and VIa transition metals of the periodic table. Mixtures and solid solutions of Al, Si, carbides, nitrides, carbonitrides and borides of Group IVa, Va, and VIa transition metals of the periodic table may also be included.

Accelerated Leaching

In various embodiments, a formed PCD body having a catalyst material in the interstitial spaces between bonded diamond grains is subjected to a leaching process in conjunction with at least one accelerating technique, whereby the catalyst material is removed from the PCD body. As used herein, the term "removed" refers to the reduced presence of catalyst material in the PCD body, and is understood to mean that a substantial portion of the catalyst material no longer resides in the PCD body. However, one skilled in the art would appreciate that trace amounts of catalyst material may still remain in the microstructure of the PCD body within the interstitial regions and/or adhered to the surface of the diamond grains. Alternatively, rather than actually removing the catalyst material from the PCD body or compact, the selected region of the PCD body or compact can be rendered thermally stable by treating the catalyst material in a manner that reduces or eliminates the potential for the catalyst material to adversely impact the intercrystalline bonded diamond at elevated temperatures. For example, the catalyst material may be combined chemically with another material to cause it to no longer act as a catalyst material (or to have less thermal mismatch with diamond), or can be transformed into another material that again causes it to no longer act as a catalyst material (or to have less thermal mismatch with diamond). Accordingly, as used herein, the terms "removing substantially all" or "substantially free" as used in reference to the catalyst material is intended to cover the different methods in which the catalyst material can be treated to no longer adversely impact the intercrystalline diamond in the PCD body or compact with increasing temperature.

The quantity of the catalyst material remaining in the material PCD microstructure after the PCD body has been subjected to a leaching treatment may vary, for example, on factors such as the treatment conditions, including treatment time. Further, one skilled in the art would appreciate that it may be acceptable or desired in certain applications to allow a small amount of catalyst material to stay in the PCD body. In a particular embodiment, the PCD body may include up to 1-2 percent by weight of the catalyst material. However, one skilled in the art would appreciate that the amount of residual catalyst present in a leached PCD body may depend on the diamond density of the material, and body thickness.

As described above, a conventional leaching process involves the exposure of an object to be leached with a leaching agent, such as described in U.S. Pat. No. 4,224,380, which is herein incorporated by reference in its entirety. In select embodiments, the leaching agent may be a weak, strong, or mixtures of acids. In other embodiments, the leaching agent may be a caustic material such as NaOH or KOH. Suitable acids may include, for example, nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

While conventional leaching techniques may require many weeks for sufficient removal of catalyst material from a PCD body to occur, in accordance with the present disclosure, accelerating techniques may be applied to the leaching process to decrease the amount of treatment time required to reach the same level of catalyst removal. Additionally, the use of the accelerating techniques of the present disclosure may also result in a more effective leaching. For example, for a given diamond body leached using conventional techniques that may have 2% of the catalyst material left in the diamond body, the application of the accelerative techniques of the present disclosure may result in a reduction in the remaining catalyst material to 1% or even 0.5%. Further, because the effectiveness/amount of metal remaining after leaching when using conventional leaching may largely depend on the diamond density of the given diamond body, the amount of reduction in the remaining catalyst material may also similarly depend on the diamond density. In a particular embodiment, the leaching of a PCD body may be accelerated by forming acid infusion pathways in the PCD body, so that the acid (or other leaching agent) may more readily access the interior portions of the PCD body, leading to a faster and cleaner leaching treatment. As used herein, the term "acid infusion pathways" refers to any passage or structure through which a leaching agent (often acid) flows with less resistance than compared to an intercrystalline network of diamond grains so that such leaching agent may more readily infuse into interior regions of the polycrystalline diamond layer. Thus, for example, such acid infusion pathways may include cavities formed from removal of PCD material from the PCD body, as well as a material structure through which a leaching agent may more easily diffuse as compared to polycrystalline diamond, such as for example, through incorporation of a metal, cermet, or cermic fiber into a diamond mixture such that a metal-, cermet- or ceramic-filled channel or passageway is formed in the PCD body. Moreover, it is also within the scope of the present disclosure that the techniques of the present disclosure may be combined with other accelerating techniques, such as application of increased temperatures, pressures, ultrasound, etc., including the techniques described in U.S. patent application Ser. No. 2008/0185189, which is assigned to the present assignee and herein incorporated by reference in its entirety.

Cavities formed by removal of PCD material may include partial cavities (cavities extending partially into the diamond layer) and/or through-cavities or channels (cavities extending the entire thickness of the diamond layer). Thus, by removing such material to form voids (reducing the distance across the thickness of a PCD body between acid contact points and also increasing the exposed diamond surface area into which a leaching agent may infuse the PCD body), a leaching agent's infusion into the PCD body and thus subsequent removal of (or reaction with) the catalyzing material disposed in interstitial spaces between the interconnect diamond grains may be accelerated as compared to infusion into a conventional PCD wafer or compact. Such cavities may be formed on any surface of the PCD body to provide greater access to the leaching agent of the diamond; however, it may be desirable, in some embodiments, to form the cavities on the surface of a PCD body that will subsequently form the interface between the leached PCD body and a substrate so that cavities may give rise to a non-planar locking interface between the leached PCD body and the substrate. In other embodiments, it may be desirable to form the cavities on the top or working surface of the PCD body so that upon later use on a bit in drilling, the cavities may help to cool the cutter. Such cavities may be formed using any technique known in the art of cutting diamond, including, for example, methods such as EDM, laser micro machining, ion beam milling (also referred to as ion bombardment etching), etc. In yet other embodiments, the cavities may be formed by molding during the HPHT sintering process whereby the polycrystalline diamond body is initially formed interfacing a substrate having projections extending from an upper surface thereof. Thus, once the diamond body is detached from the substrate, the depressions in the diamond body may be considered equivalent to the cavities discussed herein for purposes of accelerating leaching.

Alternatively, the cavity may be formed by incorporation of a discrete region of an aiding material into the diamond mixture prior to sintering, where the aiding material may be removed by chemical or physical methods prior to leaching, such that once subsequently removed, cavities are present in the polycrystalline diamond body. For example, a tungsten carbide aiding material may be formed in the diamond body, and then subsequently removed (or at least partially removed) by machining or other physical methods so that a cavity remains in the diamond body to allow for accelerated leaching. Further, aiding materials other than tungsten carbide, such as other ceramics, may also easily be used so long as the aiding material is removable by physical or chemical methods. Use of such an aiding material may be desirable if the aiding material more easily removed than cutting diamond.

In another embodiment, the acid infusion pathways may be formed during the HPHT sintering process using a filler material to form a discrete region in the diamond body that is not removed prior to leaching to form a cavity, but that may present a less resistant pathway (as compared to the surrounding interconnected diamond network) through which a leaching agent may diffuse into the PCD body. Specifically, in such an instance the discrete region may be differentiated as having a material microstructure distinct from the remaining PCD (being without or with fewer diamond-to-diamond bonds). Depending on the type of material selected, the leaching process may result in a void or cavity being formed simultaneously with the leaching. For example, if cobalt or another metal filler is used, the leaching process may remove the cobalt or other metal discrete region, thereby resulting in the formation of a void or cavity in the diamond body. However, the present disclosure is not so limited. For example, the use of a tungsten carbide (e.g., monotungsten carbide) filler material or other ceramics would not necessarily result in the formation of a cavity during the leaching process, but would provide a less resistant pathway through which the leaching agent may diffuse. Specifically, in the case of discrete regions of tungsten carbide being formed at the diamond surface, during the initial HPHT sintering process (wherein the polycrystalline diamond body is formed), the metal binder used to form the diamond layer will also sweep through the carbide region, forming a cermet in situ. Thus, similar to as described above, the metal binder (and potentially some of the tungsten carbide particles) present in tungsten carbide region may be removed by the leaching process, resulting a more porous body, and thus a pathway through which a leaching agent may more readily diffuse (than the surrounding polycrystalline abrasive body). Thus, the filler material may include various ceramics, metals, known to those skilled in the art, in various shapes (rods, powder, etc.) and dimensions (which may be selected based the desired pathway size, mean free path between carbide particles, etc.). In a particular embodiment, metal fibers such as cobalt or nickel fibers (or rods), may be used in forming the PCD body so that the resulting body has a metal filled pathway though which a leaching agent may more readily diffuse. In the case of some metals, the leaching agent may actually remove the metal filling as it contacts the PCD body, forming a cavity in situ.

Figure 2A:
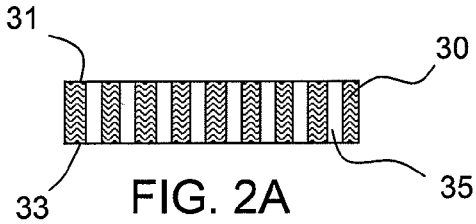
FIGS. 2A-2E show cross-sectional side views of various embodiments of the present disclosure.
Figure 2B:
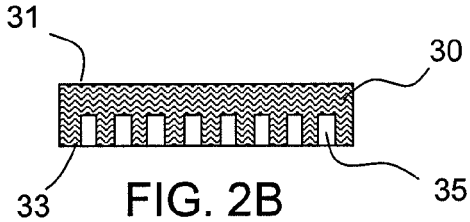
Figure 2C:
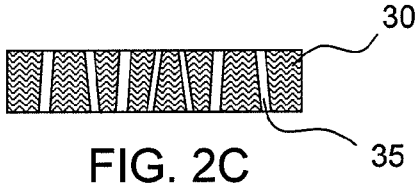
Figure 2D:
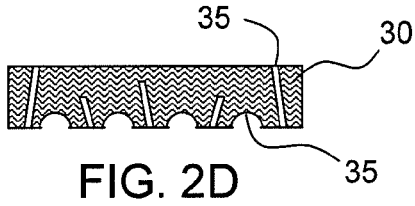
Figure 2E:
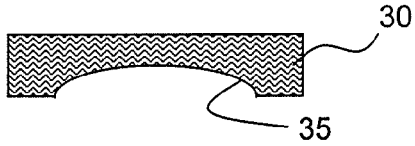

Referring to FIGS. 2A-2E, various embodiments of PCD bodies 30 having acid infusion pathways 35 formed therein are shown. As shown in FIG. 2A, acid infusion pathways 35 are through-cavities or channels, extending the entire thickness or depth of PCD body 30, from a top surface 31 to a bottom surface 33. In FIG. 2B, acid infusion pathways 35 are partial cavities, extending partially from bottom surface 33 a depth less than top surface 31. Moreover, while FIGS. 2A and 2B show pathways 35 formed perpendicular to surfaces 31, 33, the present invention is not so limited. Rather, as shown in FIGS. 2C and 2D, such pathways 35 may extend into or through PCD body 30 at an angle to surfaces 31, 33. Additionally, such pathways or cavities 35 may take any geometrical (regular or irregular) shape or form, including for example, having a generally equal or varying (e.g., pathway 35 may be a dimple as shown in FIGS. 2D and 2E) diameter along the length of the pathway 35. Additionally, as shown by comparing the general representative size of the various pathways 35 shown in FIGS. 2A-2E, pathways 35 may be selected to have different general relative dimensions depending, for example, on the methods by which the pathways 35 are being formed, among other design considerations. Thus, in some embodiments, for example, as shown in FIG. 2E, a pathway 35 may be selected to have a generally large diameter at the intersection between the pathway and a surface 31 or 33 of the PCD body 30, ranging as large as the cutter diameter or one-half the diameter of the PCD body 30, or may be smaller as illustrated shown in FIGS. 2A-2D. In particular embodiments, the diameters of the pathways (including both later-formed cavities as well as preformed filler- or aiding material-filled pathways) may range from millimeter scale (up to 3 mm in some embodiments) to microscale (less than 1 mm and less than 50 microns) to nanoscale (down to 100, 50, or 10 nm in various embodiments). In an even more particular embodiment, pathways (including both later-formed cavities and/or preformed filler- or aiding material-filled pathways) of diameter ranging from 10 microns to 1 mm (or to 0.5 mm in another embodiment) are formed in the diamond body. However, one skilled in the art would appreciate that the selected size may be based on factors such as the size of the PCD body, degree of acceleration in leaching desired, the techniques by which the pathways are formed, any effect on the material and mechanical properties of the PCD body, etc. It is also within the scope of the present disclosure that various combinations of type, number, shape, size of pathways may be made, such as shown in FIG. 2D.

Figure 3A:
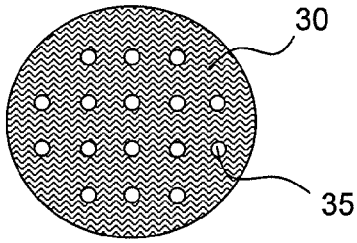
FIGS. 3A-3B show top views of various embodiments of the present disclosure.
Figure 3B:
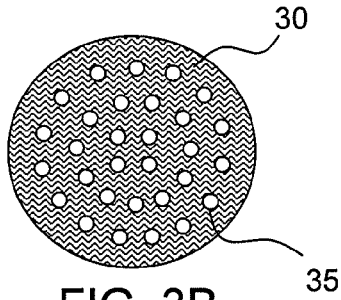

Moreover, there is also no limit on the placement or pattern of the pathways formed in the PCD body. For example, as shown in FIGS. 3A and 3B, the pathways 35 may take any regular array of even spaced pathways or form a pattern of concentric circles. However, the pathways may also be randomly distributed across a PCD body.

Further, as mentioned above, while the above discussion has applied to PCD cutting elements or bodies, those having ordinary skill in the art will appreciate that these techniques may be more generally applied to any material that requires the leaching of a material (such as a catalyst) from its surrounding matrix. In particular, embodiments disclosed herein apply to "free-standing" PCD bodies, such as, PCD wafers having no carbide substrate. Such PCD bodies may have been formed "free-standing" or may have been detached from a carbide substrate prior to leaching. However, in other embodiments, the acid infusion pathways may also be formed in PCD bodies attached to a carbide substrate. In a particular embodiment, the PCD bodies may be at least 1 mm thick, and at least 1.5 or 2 mm thick in alternate embodiments.

Further when such "free-standing" PCD bodies are leached, in particular embodiments, the leached PCD bodies may be attached (or reattached) to a substrate, to facilitate attached to a bit, cutting tool, or other end use, for example. Such methods of reattachment may include sintering a leached PCD body with a substrate material (either preformed or powder) in a second HPHT sintering step, such as discussed in U.S. Patent Publication No. 2008/0223623, which is assigned to the present assignee and herein incorporated by reference in its entirety. The HPHT sintering used to attach a diamond body to the substrate may be performed in a similar manner as described above with respect to formation of polycrystalline diamond, but in particular embodiments, such conditions may include a temperature ranging from 1350 to 1500° C. and a pressure ranging from 4 to 7 GPa. When attaching a PCD body to a substrate, the PCD body may be placed such the surface intersecting the openings of the partial acid infusion pathway may either be adjacent or not adjacent the substrate. Selection between such embodiments may be based factors such as desire for non-planar interface or desire for cooling during drilling.

Attachment or (reattachment) of the PCD body to a substrate may be achieved by placing the two pieces together and subjecting the two to sintering conditions to join the two bodies together. In embodiments in which the pathway openings are placed adjacent the substrate upper surface, during and due to the sintering conditions, some amount of carbide materials from the substrate may "bulge" into the open space of the cavities which have been formed in the PCD body, forming mechanical locking known in the art of non-planar interfaces. Alternatively, an intermediate material, such as a refractory powder (tungsten or tungsten carbide powder in particular embodiments) may be used to fill at least a portion of the cavities in the PCD, such that the intermediate material will be sintered and bond together with the carbide substrate during the sintering conditions. In such embodiments, the substrate may have a substantially planar upper surface or may have a non-planar but non-mating upper surface. In the embodiment having the non-planar, but non-mating upper surface to the substrate, a diamond body may have a "larger" cavity than the projections that exist on the substrate upper surface. Thus, while the surfaces are non-mating (defined herein as having a gap of at least 10% of at least one dimension of the cavities between the substrate and diamond body), the geometries would align based on location at the interface. In another embodiment, the gap between the diamond and substrate may be at least 25% of at least one dimension of the cavities. Further, in such embodiments, the intermediate material may be used to fill the gaps between the corresponding cavity and projection to aid in the attachment process. Other intermediate materials, such as diamond powder in combination with the refractory powder, may also be used. Another alternative embodiment may use a carbide substrate machined to have mating (less than 10% gap) geometrical projections that may occupy the cavities upon placement of the two pieces together. In such an embodiment, an intermediate material may be used between the diamond body and the substrate to minimize any mismatches therebetween, which may result in cracking during the HPHT sintering. U.S. patent application Ser. No. 61/081,619 entitled "Method of Forming a Polycrystalline Diamond Cutter," filed on Jul. 17, 2008, which is herein incorporated by reference in its entity, is directed at the use of cavities in a PCD body for forming a non-planar interface between a diamond body and a substrate.

Further, infiltrant materials present in the substrate may infiltrate into these openings, as well as into the interstitial regions (or at least a portion thereof) previously occupied by the catalyzing material that has been removed by the leaching process, as discussed in U.S. patent application Ser. No. 60/941,616. Such infiltration with a variety of infiltrants or replacement materials using any number of techniques, including liquid-phase sintering under HPHT conditions, pressure techniques. The type of infiltrant or replacement material is not a limitation on the scope of the present disclosure. Rather any type of infiltrant or replacement materials may be used, including, for example, non-refractory metals such as copper or other Group IB metals or alloys thereof, Group VIII metals such as cobalt, nickel, and iron, ceramics, silicon, and silicon-containing compounds, ultra-hard materials such as diamond and cBN. In a particular embodiment, the source of infiltrant or replacement material may be a substrate that is attached to the leached PCD body during an HPHT process. Substrates useful in this regard may include those substrates that are used to form conventional PCD, including those formed from metals, ceramics, and/or cermet materials that contain a desired infiltrant, such as a substrate formed from WC-Co.

Additionally, although a substrate may be attached to the leached PCD body during the introduction of the replacement infiltrant material, it is also understood that the substrate may alternatively be attached to the PCD body after the desired infiltrant has been introduced. In such an embodiment, the infiltrant material may be introduced, for example, by an HPHT process that does not use the substrate material as an infiltrant source, and the desired substrate may be attached to the diamond body by a separate HPHT process or other method, such as by brazing, welding, or the like. Alternatively, no replacement infiltrant may be used, and the substrate may be attached by brazing, welding, sintering, or the like. Further, one skilled in the art would also appreciate that, as described in U.S. patent application Ser. No. 60/941,616, an intermediate material may be attached between the PCD body and a substrate to facilitate attachment or acting as a barrier to prevent or minimize the migration of catalyst material within the substrate into the PCD body.

Figure 4A:
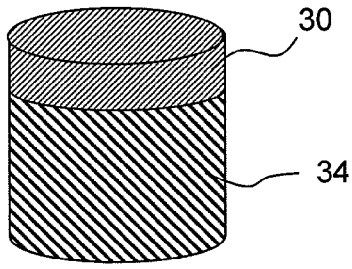
FIGS. 4A-4E is an illustration of steps for forming a PDC cutter in accordance with an embodiment of the present disclosure.
Figure 4B:
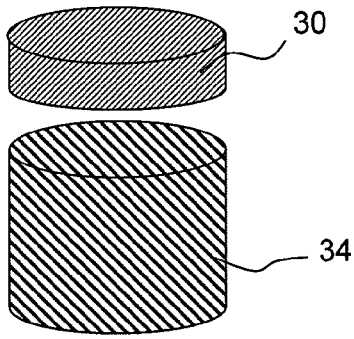
Figure 4C:
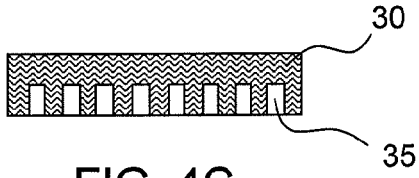
Figure 4D:
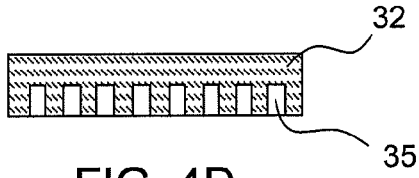
Figure 4E:
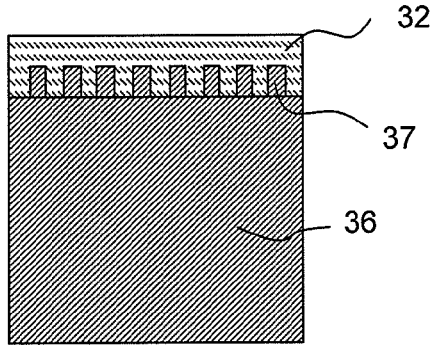

Referring to FIGS. 4A-4E, collectively, an embodiment of the process steps of the present disclosure is shown. As shown in FIG. 4A, a polycrystalline diamond body 30 having a catalyzing material found in the interstitial regions between the diamond grains (as described above) may be formed attached to a carbide substrate 34. The polycrystalline diamond body 30 may be detached (shown in FIG. 4B) from the substrate 34 prior to formation of acid infusion pathways 35 and treatment of the polycrystalline diamond body 30 by leaching techniques disclosed herein. Alternatively, a polycrystalline diamond body 30 may be formed without a substrate. While FIG. 4C shows formation of acid infusion pathways 35 in the polycrystalline diamond body 30 after formation of the diamond body, alternatively, the pathways may be formed during HPHT sintering as described above. Leaching of polycrystalline diamond body 30 removes at least a substantial portion of the catalyzing material from the interstitial regions, leaving a polycrystalline diamond body 32 (shown in FIG. 4D) having voids (other than pathways 35) dispersed in the diamond matrix or regions that were previously occupied by catalyzing material. Further, as shown in FIG. 4E, the polycrystalline diamond body 32 may then be attached (or reattached) to a substrate 36 through sintering. In the embodiment shown in FIG. 4E, the openings of pathways 35 are placed adjacent the substrate so that after reattachment sintering, an non-planar interface may be formed with a portion of substrate 37 filling any previously open space of pathways 35.

Following all processing and treatment steps, the cutting elements of the present disclosure may have a polycrystalline diamond body having diamond grains with an average grain size of less than 20 microns, and ranging from about 9 to 15 microns in a particular embodiment. Such average grain sizes after treatment may be estimated by using electron backscatter diffraction of cross-sections of multiple PCD bodies with a scanning electron microscope, and using a mean linear intercept method.

Embodiments of the present disclosure may provide for at least one of the following advantages. Conventional leaching techniques, such baths may take as much as twelve weeks (for low density diamond) or more (greater diamond density and/or thickness) to achieve the desired removal of catalyzing material. However, formation of acid infusion pathways in the polycrystalline diamond body may reduce the leach time by allowing for greater access of the leaching agents into the interior regions of the diamond body. Additionally, if the leached PCD bodies are later attached (or reattached) to a substrate and if the openings of the pathways are adjacent the substrate, risk of delamination may be decreased due to the mechanical locking which may result from carbide bulging into the cavities or a refractory powder added to the cavities bonding with the substrate. Conversely, advantages may also result from having the openings lay on the ultimate working or top surface of the formed cutter. In such embodiments, the pathways may form cooling channels to more quickly cool the cutting edge from the elevated temperatures experienced during drilling. By having such pathway exposed to the top surface, drilling fluids may more readily be brought to the contact interface to reduce friction and frictional heat generation. Moreover, for any fluid which may fill the cavities, the fluid may act as a coolant exposed to interior portions of the PDC body, which may cool the PCD by convective cooling when the temperature rises. When the temperature rises rapidly, the fluid may vaporize and absorb a large amount of heat, protecting the cutting edge from thermal damage.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method for forming a thermally stable cutting element, comprising:

forming at least one acid infusion pathway in a polycrystalline abrasive body containing a catalyzing material to be leached, wherein the step of forming comprises:

forming a discrete region within the polycrystalline abrasive body, wherein the discrete region comprises a material microstructure distinct from the polycrystalline abrasive body; and removing the discrete region; and contacting at least a portion of the at least one acid infusion pathway in the polycrystalline abrasive body with a leaching agent.

2. The method of claim 1, wherein the discrete region is removed during the contacting step to form in situ the at least one acid infusion pathway.

3. The method of claim 1, wherein the discrete region comprises an aiding material.

4. The method of claim 1, wherein the discrete region comprises a filler material.

5. The method of claim 4, wherein the filler material comprises at least one of a Group VIII metal or a metal carbide.

6. The method of claim 1, wherein the at least one acid infusion pathway comprises a channel extending through an entire thickness of the polycrystalline abrasive body.

7. The method of claim 1, wherein the at least one acid infusion pathway extends a partial thickness into the polycrystalline abrasive body.

8. The method of claim 1, wherein the acid infusion pathway has an opening with at least one dimension of less than 3 mm.

9. The method of claim 1, wherein the acid infusion pathway has a diameter ranging from about 10 microns to 1.0 millimeters in size.

10. The method of claim 1, further comprising:

attaching the polycrystalline abrasive body to a substrate.

11. The method of claim 10, wherein the attaching comprises: subjecting the polycrystalline abrasive body and substrate material to high pressure/high temperature sintering conditions.

12. The method of claim 10, wherein the substrate has a substantially planar upper surface.

13. The method of claim 1, further comprising: attaching the polycrystalline abrasive body to a substrate, wherein the substrate has a non-planar, non-mating upper surface.

14. The method of claim 1, further comprising: attaching the polycrystalline abrasive body to a substrate, wherein the substrate has a substantially mating upper surface.

15. The method of claim 1, further comprising:

filling at least a portion of the at least one acid infusion pathway with an intermediate material;

placing the polycrystalline abrasive body adjacent a substrate material; and subjecting the polycrystalline abrasive body and substrate material to high pressure/high temperature sintering conditions.

16. The method of claim 1, further comprising:

forming the polycrystalline abrasive body attached to a substrate comprising:

placing a mixture of abrasive particles and a catalyst material adjacent a substrate having projections on the upper surface thereof; and subjecting the mixture and substrate to high-pressure/high temperature sintering conditions to form a polycrystalline diamond body having depressions that interface the projections, wherein the projections form the discrete regions within the polycrystalline abrasive body;

detaching the polycrystalline abrasive body from the substrate;

wherein the depressions in the polycrystalline abrasive body, once detached, comprise the at least one acid infusion pathway in the polycrystalline abrasive body.

* * * * *